US005654724A

United States Patent [19]

Chu

[11] Patent Number: 5,654,724

[45] Date of Patent: Aug. 5, 1997

[54] ANTENNA PROVIDING HEMISPHERICAL OMNIDIRECTIONAL COVERAGE

[75] Inventor: Tai-Tseng Chu, Simi Valley, Calif.

[73] Assignee: Datron/Transco Inc., Simi Valley, Calif.

[21] Appl. No.: 512,106

[22] Filed: Aug. 7, 1995

[51] Int. Cl.[6] ..... H01Q 9/38; H01Q 21/24

[52] U.S. Cl. ..... 343/742; 343/830; 343/844; 343/846; 343/855

[58] Field of Search ..... 343/855, 741, 343/742, 846, 830, 831, 844, 803; H01Q 9/30, 9/38, 9/42, 11/14, 21/00, 21/24, 21/26

[56] References Cited

U.S. PATENT DOCUMENTS 4,540,988 9/1985 Munk et al. ..... 343/855

4,611,212 9/1986 Lee ..... 343/844

*Primary Examiner*—Michael C. Wimer

*Attorney, Agent, or Firm*—Edward A. Sokolski

[57] ABSTRACT

An antenna having an omnidirectional pattern in azimuth and coverage throughout a hemisphere. The radiating elements are four half-loops mounted on a ground plane. Each half-loop is approximately one-half wavelength in length with one end grounded to the ground plane and the other end fed in opposition to the ground plane. The image produced by the ground plane of each half-loop, together with the actual half-loops give the effect of a set of four complete loops, each of which complete loops is approximately one wavelength in circumference. The elements are nominally located in planes normal to the ground plane that pass through a central point in the ground plane. The planes of the elements are oriented nominally at 90 degree intervals about a central point and the centers of the elements are offset from the central point of the ground plane by approximately one-quarter wavelength. The combination of elements produces an omnidirection radiation pattern in azimuth. The radiation pattern contains no null on axis, but does exhibit a moderately reduced intensity on axis. With altered phasing of the elements and the number of driven elements, the antenna can provide monodirectional coverage of a hemisphere, or bidirectional or multidirectional coverage within a hemisphere.

8 Claims, 2 Drawing Sheets

ANTENNA PROVIDING HEMISPHERICAL OMNIDIRECTIONAL COVERAGE

1. BACKGROUND OF THE INVENTION a. Field of the Invention

This invention pertains to omnidirectional antennas. More particularly, this invention pertains to antennas that provide hemispherical omnidirectional coverage or coverage of selected sectors of a hemisphere for use in cellular communication systems.

b. Description of the Prior Art

A simple quarter-wave length vertical conductor mounted on, and feed in opposition to, a ground plane provides an omnidirectional radiation pattern in azimuth. Classical antennas of this type are well known in the art. Such an antenna, however, has a null in the radiation pattern at the zenith, i.e. directly above the vertical conductor. In many applications, the null at the zenith is not important. However, the relatively recent development of cellular communications systems has brought with it a requirement for an omnidirectional pattern with no null at the zenith and in some circumstances for coverage of selected sectors of a hemisphere. For instance, an objective of a cellular communication system may be to provide coverage throughout one room from one antenna mounted on the ceiling of the room or to provide coverage throughout a building from one antenna mounted under the roof of the building. In such instances, in order to provide communications coverage throughout the hemisphere below the antenna, the antenna must not only provide omnidirctional coverage in azimuth, but must also not have a null in the radiation pattern immediately below the antenna.

2. SUMMARY OF THE INVENTION

The present invention is an antenna consisting of four radiating elements mounted on a conducting ground plane, which antenna may be placed "upside down" on the ceiling of a room, or under the roof of a building, to provide a radiation pattern that covers the entire room or building below the antenna. Although the radiation pattern of the present invention has no null directly below the antenna, the radiation pattern directly below the antenna is reduced in amplitude. The amplitude is reduced to compensate for the fact that a mobile unit located on the floor of the room directly below the antenna would normally be closer to the antenna in comparison to other locations in the room. By altering the phasing of the radiating elments, coverage is provided for selected sectors of the room or building.

Each radiating element consists of conductor in the form of one-half of a loop, which half-loop is mounted on the ground plane. One end of the half-loop is grounded to the ground plane and the other end of the half-loop is located adjacent to the ground plane and is "excited" or "fed" in opposition to the ground plane. The ground plane generates images of the half-loops, thus, in effect, providing on the radiating element side of the ground plane a radiation pattern that is equivalent to that of four complete loops without a ground plane. Of course, on the side of the ground plane opposite to the radiating elements, the ground plane shields the radiation from the elements, and the radiation pattern on the shielded side of the ground plane differs substantially from the pattern generated on the element side of the ground plane. When mounted in the ceiling of a room, the antenna is mounted "upside down" in the sense that the radiating elements are located underneath, on the bottom surface of, the ground plane.

3. BRIEF DESCRIPTION OF THE DRAWINGS

4. DETAILED DESCRIPTION

Figure 1:
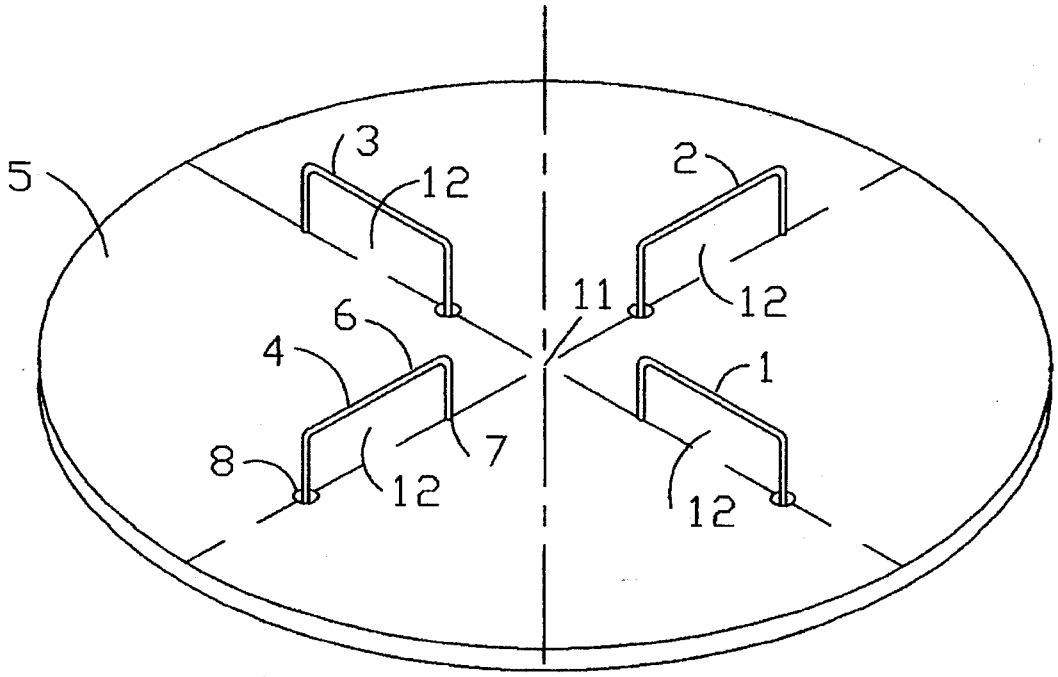
FIG. 1 depicts the invention.

Referring now to FIG. 1. Radiating elements 1, 2, 3 and 4 are mounted upon a conducting ground plane 5. Radiating element 1 consists of a conductor 6 that is nominally one-half wavelength in length with the ground end 7 of the element being electrically grounded to ground plane 5 and the feed end 8 of the element being located adjacent to ground plane 5 and being electrically excited, fed or driven in opposition to the ground plane.

Figure 2:
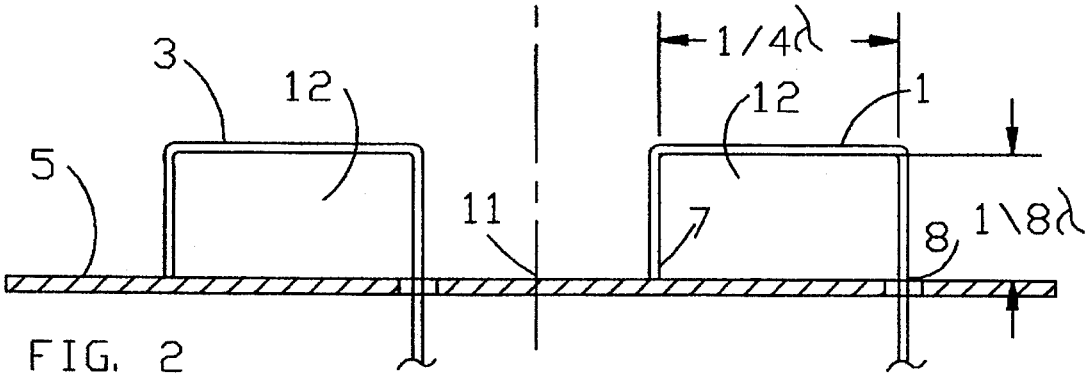
FIG. 2 is a cross-sectional view of the invention showing two of the radiating elements.
Figure 3:
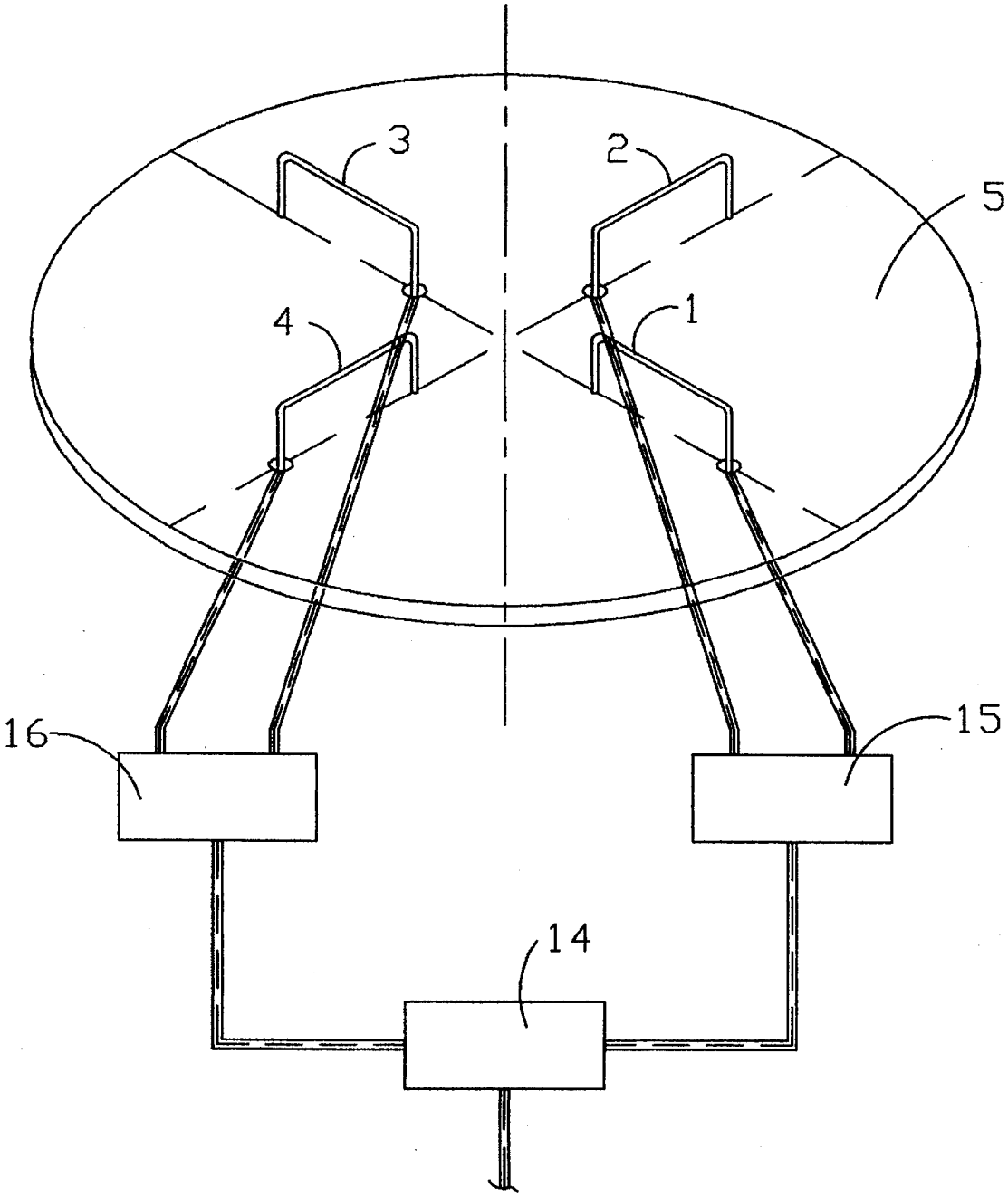
FIG. 3 depicts a system for feeding the four radiating elements of the antenna.

As depicted in FIG. 2, in the preferred embodiment, the feed end of element 1 is driven by connection to inner conductor 8 of coaxial cable 9 which passes through a hole or insulated passageway through ground plane 5. Outer shield 10 of coaxial cable 9 is electrically connected to ground plane 5. The ground plane, in effect, creates an electrical image of element 1, which image of element 1 together with element 1, act as if element 1 were an electrical loop of nominally one-wavelength in circumference.

In each half-loop element, the largest current flows in the portion of the loop that is normal to the ground plane. The current flowing in the horizontal portion (that is parallel to the ground plane) decreases towards the center of the horizontal portion and undergoes a phase reversal. As a consequence the currents in the vertical portions of the half-loops are nominally in phase. Except for the region near the zenith, the currents flowing in the vertical portions of the half-loops are the major contributors to the radiated field.

Elements 2, 3 and 4 are similar to element 1 and, as depicted in FIG. 1, are located at 90 degree intervals about central point 11 of the ground plane. Elements 2 and 3, however, differ from elements 1 and 4 in that the feed points for elements 1 and 4 are located at the outer ends of the loops, away from central point 11, while the feed points of elements 2 and 3 are located at the inner ends of the loops, near to central point 11. As depicted in FIGS. 1 and 2, the central area 12 of each loop is nominally located approximately one-quarter wavelength in physical distance from central point 11.

The antenna exhibits a wide bandwidth over which it provides a useable radiation pattern and an acceptable input impedance. Because the dimensions of the antenna and the radiating elements have been expressed in terms wavelengths, the dimensions, when expressed in terms of the actual wavelength at which the antenna is being used, will depart substantially, from the nominal values used to describe the preferred embodiment of the antenna. For instance, the length of the radiating element could range from approximately 0.3 wavelengths up to 0.8 wavelengths and the nominal spacing of the centers of the radiation elements from the central point in the ground plane could range in a similar fashion, i.e. from 0.15 wavelength to 0.4 wavelength. Although in the preferred embodiment the radiating elements are depicted as being rectangular in shape, the shape of the loops may depart substantially from that of rectangles, e.g. the loops could be in the form of semi-circles or even some other rather irregular shape. Although in the preferred embodiment the radiating elements have been depicted as lying in planes normal to the ground plane, the elements need not lie entirely in such planes, or in any one plane, nor need the nominal plane of each element be normal to the ground plane. Similarly the angular spacings between the elements need not be exactly equal and may depart somewhat from intervals of ninety degrees. The offsets of the elements from the central point on the ground plane also need not be exactly the same. For that matter, the central point in the ground plane is simply a reference point for use in the description of the invention and need not be located absolutely in the center of the ground plane.

In the preferred embodiment, the four elements are fed from a single source 13 by means of power dividers 14, 15 and 16. Power divider 14 is connected to power dividers 15 and 16 by coaxial cables of equal length and power dividers 15 and 16 are connected to the feed points of elements 1 through 4 by coaxial cables of equal length.

If elements 2 and 3, instead, are fed out of phase to elements 1 and 4, i.e. are fed with a phase shift of 180 degrees relative to elements 1 and 4, the antenna provides a bidirectional pattern, the center of one lobe radiating outward between elements 1 and 4 and the center of the second lobe radiating outward in the opposite direction between elements 2 and 3.

If elements 1 and 3 are fed in phase and element 2 is fed with a phase shift of +45 degrees relative to elements 1 and 3 and element and 4 is fed with a phase shift of −45 degrees relative to elements 1 and 3, then the antenna will generate a pattern having one major lobe having its maximum centered between elements 1 and 3. If, instead, element 2 is fed with a phase shift of −45 degrees relative to elements 1 and 3, and element 4 is fed with a phase shift of +45 degrees relative to elements 1 and 3, the same pattern would be generated, except that the direction of the major lobe will be reversed. Similarly, if elements 2 and 4 are in phase and elements 1 and 3 are fed with phase shifts of +45 degrees and −45 degrees respectively, a pattern will be generated having one major lobe centered between elements 2 and 4.

5. CLAIMS

I claim:

1. An antenna providing omnidirectional coverage of a hemisphere comprising:

a ground plane having a central point, first, second, third and fourth radiating elements, each radiating element comprising a conductor having a feed end and a ground end, the length of the conductor between the feed end and the ground end being roughly one-half wave in length, the ground end of each radiating element being grounded to the ground plane and the feed end of each radiating element being located adjacent to the ground plane and having a feed point between the feed end of the radiating element and a portion of the ground plane adjacent thereto, the conductor of each radiating element, together with a portion of the ground plane, forming an electrical loop having a central portion, the central portion of each loop being located roughly one-quarter wavelength from the central point of the ground plane, each loop having an inner end and an outer end relative to the central point of the ground plane, the first, second, third and fourth radiating elements, in sequence, being angularly located at intervals of approximately 90 degrees about the central point of the ground plane, the ground ends of the first and fourth loops being the outer ends of the first and fourth loops respectively, and the ground ends of the second and third loops being the inner ends of the second and third loops respectively, the feed points of all of the radiating elements being fed substantially in phase with each other.

2. An antenna providing bidirectional coverage within a hemisphere comprising:

a ground plane having a central point, first, second, third and fourth radiating elements, each radiating element comprising a conductor having a feed end and a ground end, the length of the conductor between the feed end and the ground end being roughly one-half wave in length, the ground end of each radiating element being grounded to the ground plane and the feed end of each radiating element being located adjacent to the ground plane and having a feed point between the feed end of the radiating element and a portion of the ground plane adjacent thereto, the conductor of each radiating element, together with a portion of the ground plane, forming an electrical loop having a central portion, the central portion of each loop being located roughly one-quarter wavelength from the central point of the ground plane, each loop having an inner end and an outer end relative to the central point of the ground plane, the first, second, third and fourth radiating elements, in sequence, being angularly located at intervals of approximately 90 degrees about the central point of the ground plane, the ground ends of the first and fourth loops being the outer ends of the first and fourth loops respectively, and the ground ends of the second and third loops being the inner ends of the second and third loops respectively, the feed points of first and fourth radiating elements being fed with a first phase, and feed points of the second and third elements being fed with a second phase, the second phase differing by approximately 180 degrees from the first phase.

3. An antenna providing monodirectional coverage within a hemisphere comprising:

a ground plane having a central point, first, second, third and fourth radiating elements, each radiating element comprising a conductor having a feed end and a ground end, the length of the conductor between the feed end and the ground end being roughly one-half wave in length, the ground end of each radiating element being grounded to the ground plane and the feed end of each radiating element being located adjacent to the ground plane and having a feed point between the feed end of the radiating element and a portion of the ground plane adjacent thereto, the conductor of each radiating element, together with a portion of the ground plane, forming an electrical loop having a central portion, the central portion of each loop being located roughly one-quarter wavelength from the central point of the ground plane, each loop having an inner end and an outer end relative to the central point of the ground plane, the first, second, third and fourth radiating elements, in sequence, being angularly located at intervals of approximately 90 degrees about the central point of the ground plane, the ground ends of the first and fourth loops being the outer ends of the first and fourth loops respectively, and the ground ends of the second and third loops being the inner ends of the second and third loops respectively, the first and third loops being fed with a first phase, and the second loop being fed with a second phase and the fourth loop being fed with a third phase, the second phase differing from the first phase by approximately + or −45 degrees and the third phase differing from the first phase by approximately + or −45 degrees and differing from the second phase by approximately 90 degrees.

4. An antenna providing monodirectional coverage within a hemisphere comprising:

a ground plane having a central point, first, second, third and fourth radiating elements, each radiating element comprising a conductor having a feed end and a ground end, the length of the conductor between the feed end and the ground end being roughly one-half wave in length, the ground end of each radiating element being grounded to the ground plane and the feed end of each radiating element being located adjacent to the ground plane and having a feed point between the feed end of the radiating element and a portion of the ground plane adjacent thereto, the conductor of each radiating element, together with a portion of the ground plane, forming an electrical loop having a central portion, the central portion of each loop being located roughly one-quarter wavelength from the central point of the ground plane, each loop having an inner end and an outer end relative to the central point of the ground plane, the first, second, third and fourth radiating elements, in sequence, being angularly located at intervals of approximately 90 degrees about the central point of the ground plane, the ground ends of the first and fourth loops being the outer ends of the first and fourth loops respectively, and the ground ends of the second and third loops being the inner ends of the second and third loops respectively, the second and fourth loops being fed with a first phase, and the first loop being fed with a second phase and the fourth loop being fed with a third phase, the second phase differing from the first phase by approximately + or −45 degrees and the third phase differing from the first phase by approximately + or −45 degrees and differing from the second phase by approximately 90 degrees.

5. The antenna of claim 1 in which the conductor of each radiating element is located approximately in a plane normal to the ground plane and passing through the central point of the ground plane.

6. The antenna of claim 2 in which the conductor of each radiating element is located approximately in a plane normal to the ground plane and passing through the central point of the ground plane.

7. The antenna of claim 3 in which the conductor of each radiating element is located approximately in a plane normal to the ground plane and passing through the central point of the ground plane.

8. The antenna of claim 4 in which the conductor of each radiating element is located approximately in a plane normal to the ground plane and passing through the central point of the ground plane.

* * * * *